United States Patent [19]

Holmes

[11] Patent Number: 4,926,572

[45] Date of Patent: May 22, 1990

[54] MEDICATION TIMING DEVICE

[75] Inventor: Gordon W. Holmes, Toronto, Canada

[73] Assignee: Professional Packaging Limited, Mississauga, Canada

[21] Appl. No.: 235,500

[22] Filed: Aug. 24, 1988

[30] Foreign Application Priority Data

Aug. 24, 1987 [GB] United Kingdom ..... 8719932

[51] Int. Cl.[5] ..... G09F 9/00

[52] U.S. Cl. ..... 40/448; 368/10

[58] Field of Search ..... 40/310, 299, 312, 642, 40/448; 368/10, 281, 282, 283; 116/308; 206/534; 221/2, 3, 15

[56] References Cited

U.S. PATENT DOCUMENTS

| | | | |
|---|---|---|---|
| 4,258,354 | 3/1981 | Carmon et al. | 221/2 |
| 4,389,963 | 6/1983 | Pearson | 116/308 |
| 4,419,016 | 12/1983 | Zoltan | 221/2 |
| 4,473,884 | 9/1984 | Behl | 221/2 |
| 4,553,670 | 11/1985 | Collens | 116/308 |

*Primary Examiner*—Cary E. Stone

*Attorney, Agent, or Firm*—Sim & McBurney

[57] ABSTRACT

A medicament regimen control device is provided which prompts a patient to take the correct medication to a predetermined regimen. A liquid crystal display is used to display the numbers of doses of medicaments which are color and alphabet keyed to specific bottles of the medication.

10 Claims, 4 Drawing Sheets

MEDICATION TIMING DEVICE

FIELD OF INVENTION

The present invention relates to devices for assisting in the correct administration of medication to a patient.

BACKGROUND TO THE INVENTION

It is a well known fact in the medical and pharmaceutical fields that the hazards of noncompliance among patients responsible for their own medication regimen have attained alarming levels with far reaching effects.

It has long been felt that patient instruction and education on the importance of drug compliance and the therapeutic benefits accruing to the patient would decrease the level of errors and enhance patient performance in this area. At a recent major symposium on drug compliance sponsored by the National Pharmaceutical Council, clinical reports make it clear that such is not the case. One research study reports:

> "... one would expect the IQ and educational level of the patient, as well as his or her knowledge of the disease and its treatment to affect compliance. The evidence suggests otherwise: 70% of the studies found no such relationship."

Patient instruction for short term (less than one month) medical treatments has been shown to have some benefits but has no lasting effect on long term compliance.

Most researchers and clinicians agree that the level of noncompliance has been shown to be about 40%—and reaching 50% or more with long-term chronic patients. This means that at least with 40% of the prescriptions written, there is overuse, underuse and misuse and the patient is not benefiting fully from the intended efficacy of the drug. In fact, life-threatening circumstances may arise instead.

In this regard it has been reported that in the United States 125,000 heart and hypertensive patients die prematurely each year due to noncompliance with their medication regimen.

Not only the health hazards but also the economic effects resulting from noncompliance are astronomical if one considers all the factors. One researcher (McDaniel et al 1982) checked on 7 patients identified as noncompliers by their physicians and discovered that for just this small number there were direct costs incurred of more than $14,000. These included outpatient visits, emergency room visits and hospital days, directly attributable to noncompliance over a 12-month period. These costs do not include loss of man hours on the job or financial stresses in the home.

It is estimated that 1.8 billion prescriptions are filled annually in the United States. Statistics indicate that at least 720,000,000 of these prescriptions are used incorrectly by the patient. The implications of this in a medical, health-care sense are staggering apart from the enormous economic waste involved on an international scale.

Mark R. Knowles, President, National Pharmaceutical Council states:

> "Noncompliance with medication regimens is emerging as a major public health problem. Noncompliance can take the form of underuse, overuse, or erratic use of prescribed medicines. At least one of every three prescriptions dispensed in the United States is taken incorrectly.
>
> Researchers have documented the extent and causes of noncompliance and have indicated possible remedies. Nevertheless, medical practitioners, insurers, and consumers generally underestimate the negative impact of noncompliance. Not only does noncompliance adversely affect public health, it also results in increased utilization of costly medical services."

SUMMARY OF INVENTION

The present invention provides a device, herein called a Medi-Prompter, which is a programmable electronic device which will serve as an "Aide Memoire" for the patient who has the responsibility of taking his or her own prescription drugs according to the physician's dosage regimen.

The Medi-Prompter (trade mark) is designed to be small and portable by the ambulatory patient and emits a pleasant beep or tone at each medication period at which time the patient is scheduled to take his prescribed dosage. The device may be not much larger than a 50¢ coin and can be conveniently carried in the pocket or purse or adhered to a convenient location for bed-ridden or confined patients in the home, retirement residences, etc.

Medi-Prompter can be programmed by the physician, pharmacist or by the patient, and is no more difficult to program than a normal digital watch. The device is capable of accommodating up to four different prescription drugs with over 100 different dosage regimens from which to select.

Accordingly, the present invention provides a medicament regime control device, comprising a housing having an upper face, variable display means in the upper face having a plurality of individual side-by-side displays for displaying numerals therein to convey selected messages corresponding to the number of units of medication of selected ones of differing medicaments, and individual distinguished indicia on said upper face one adjacent each of said displays corresponding to individual medicaments to be taken by a patient.

The present invention utilizes a color code system plus an alpha designation which is keyed to the patient's supply of prescription drugs.

DESCRIPTION OF PREFERRED EMBODIMENT

Figure 1A:
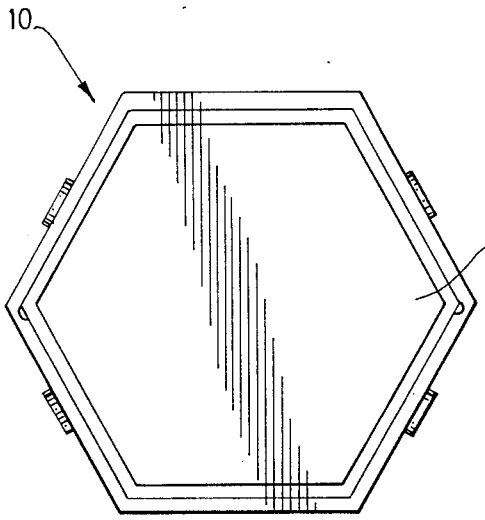
FIGS. 1A to 1D illustrate combination of a device constructed in accordance with one embodiment of the invention.
Figure 1B:
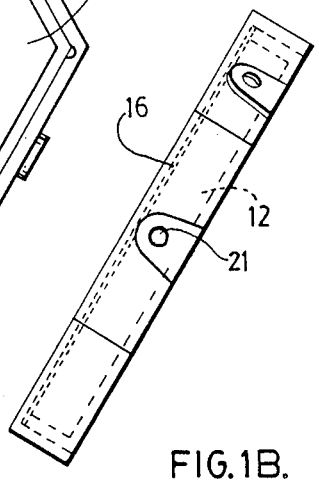
Figure 1D:
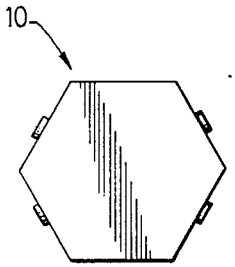
Figure 1C:
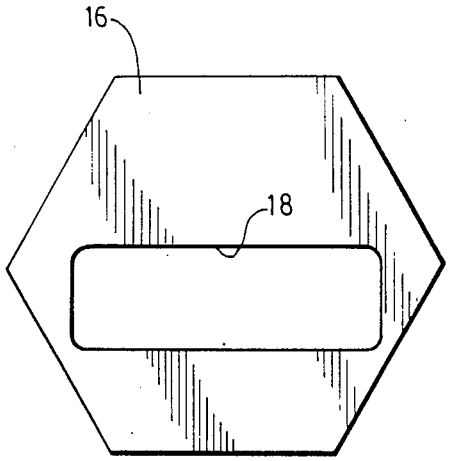

Referring to the drawings, FIG. 1 illustrates the construction of the container 10, an elevational view appearing in FIG. 1A, a side view appearing in FIG. 1B, a die-cut label appearing in FIG. 1C and the approximate actual size of the container appearing in FIG. 1D.

As may be seen, the container 10 is of shallow depth, sufficient to house a circuit board for electronic controls for the display (see FIGS. 2 to 4), and of hexagonal shape. The hexagonal shape is preferred, since it is readily packaged for shipment and storage with a minimum of wasted space, but any other desired shape may be employed, such as circular.

Figure 2:
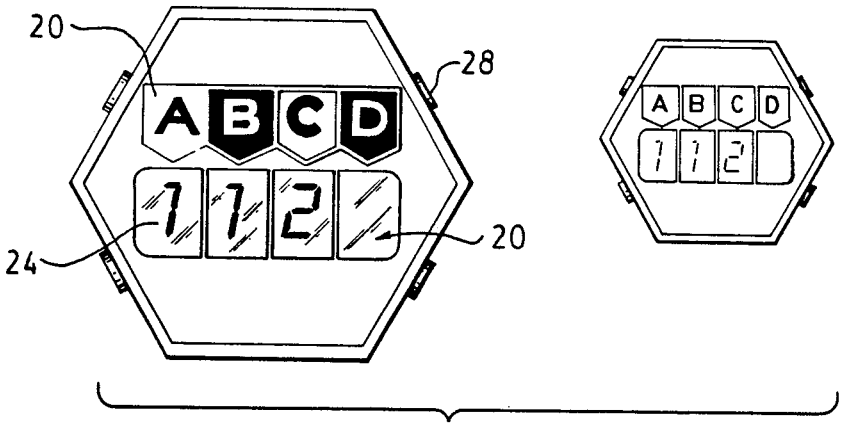
FIG. 2 is a plan view of the device of FIG. 1 with the display in a dosage mode.
Figure 3:
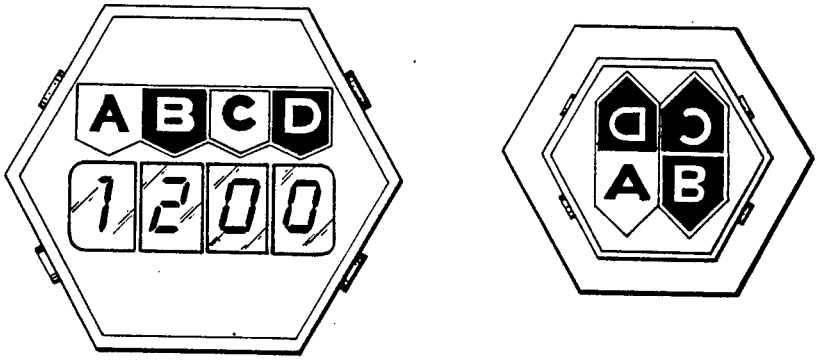
FIG. 3 is a plan view of the device of FIG. 1 with the display in a time mode.
Figure 4:
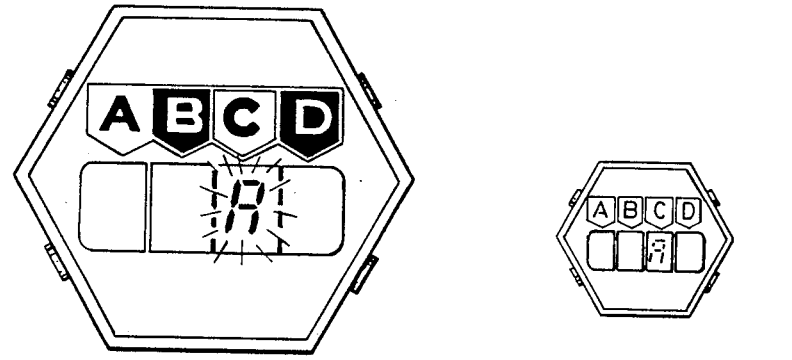
FIG. 4 is a plan view of the device of FIG. 1 with the display in a reminder mode.

The container 10 has an opaque base 12 and a transparent lid 14 which slide together into a locked position With a die-cut printed card 16 sandwiched between the lid 14 and the base 12 with an aperture 18 cut therein for a liquid crystal display 20 (see FIGS. 2 to 4). Recessed programming pins 21 may be provided in the side to permit programming by a physician or pharmacist while inhibiting accidental reprogramming by a patient.

Figure 6:
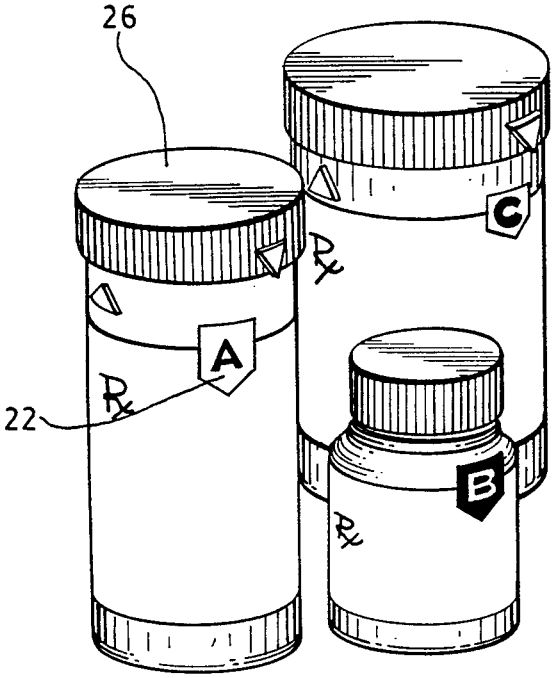
FIG. 6 illustrates coding of medication to coding used with device of FIG. 1.
Figure 6:
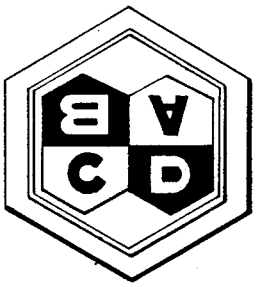

Printed on the die-cut card 16 are a plurality of individual color-coded indicia 22 opposite one of each of the individual members 24 of the liquid crystal display 20, each of the indicia also bearing a distinctly-different letter. FIG. 6 shows use of the individual indicia 22, in the form of pressure-sensitive labels, on individual bottles 26 of medication. The medication in the individual bottles 26 is color- and letter-coded so as to be identified by the individual liquid crystal display members 24. For clarity and ease of identification by the patient, the labels for the medication vials can be much larger than the image on the device 10. These labels may be packaged with the device for removal by the pharmacist.

The device 10 is controlled and programmed to display the number of doses of medicament and the time of administration of such dosage. Any convenient electronic circuit to achieve the required display may be employed. An audible prompting device also may be incorporated.

At least 98% of the potential dosage regimens used by physicians may be accommodated by the Medi-Prompter 10 with built-in patient convenience for differing times of rising and varying meal times during the day. In this way, the physician's directions for 'before' or 'after' meals and differing times when a patient normally retires at night, can be accommodated. About 100 different medication regimens are available and easily selected for programming using a two digit number on the Medi-Prompter.

The Medi-Prompter can accommodate the normal dosage regimens of 1 per day, 2 per day, 3 per day and 4 per day with numerous time options for the patient plus special programs for certain drugs that may require administration up to one dose every 4 hours.

At every dosage period at which the patient is required to take medication, a harmonious tone or beep is emitted by the device 10. In addition to this audible warning, there will be a visual reminder and further instruction to the patient by the flashing numbers on the LCD screen on the face of the Medi-Prompter. If, for example, at 12 noon the patient is to take one tablet of Drug A, one tablet of Drug B and two capsules of Drug C, then these numbers show in the appropriate zone immediately below the correct alpha designation, as seen in FIG. 2. These numbers flash or pulsate for a predetermined period of time, say approximately 10 minutes, as an additional reminder to the patient. The patient can elect to push a button 28 to turn off the flashing numbers to show that he has taken his drugs, or the device may be left alone to turn off automatically. In either instance, the device 10 is automatically programmed for the next medication period.

At a subsequent medication period, if the number 1 flashes under the alpha designator marked "B", the patient knows immediately that one tablet of Drug B is due. With facility, the patient can identify the medication vial with the distinctly-colored label, say red, and the alpha designator as a double check that the correct drug is being taken.

The pharmacist may elect to program the device 10 for the patient and to affix the appropriate label to the vial or bottle of medication, especially for the elderly patient. The pharmacist may be equipped with a device in which the device 10 is inserted and which automatically programs the device as the pharmacist types out the label copy and dosage times that appear on the prescription label. Some patients, however, may prefer to program their own Medi-Prompter. A patient medication chart may be printed to provide a record for the patient of each medication to be taken, the correct dosage regimen each day and the times of administration of the medication.

Chronic patients on long-term medication are notoriously delinquent in refilling prescriptions that often are essential to on-going patient care. Sometimes they are refilled several weeks late or not at all. Another unique feature of the device 10 is its ability to remind the patient when it is time to refill the prescription. The device 10 flashes an "R" on the LCD 20 in the space below the alpha designator at a predetermined time, say 5 days, before the existing supply runs out (see FIG. 4). The device 10 continues to flash until turned off during that period, giving the patient five days in which to fill the prescription at his local pharmacy.

In addition, the pharmacist may be provided with a computerized re-order program for repeat prescriptions. The program is intended to inform the pharmacist to phone the patient to refill at a predetermined time, say five days, before the existing supply runs out. This operation has the benefit, not only of reminding the patient but provides an opportunity to refill the prescription during off-peak or prearranged times, thereby decreasing waiting by the patient.

FIG. 5 shows a modification to the structure of the device 10. As seen therein, the device 10' is provided with end tabs 30, which are provided joined at top and bottom of the device by living hinges 32. The end tabs have an elongate slot 34 and locking keys 36, which enable the tabs to be folded flat and locked into openings 38 in the rear face 40 of the device 10', when not required in use. The rear face 40 has recessed areas 42 to receive the folded-over tabs and a space 44 for a pressure sensitive-adhesive strip 46.

Figure 5A:
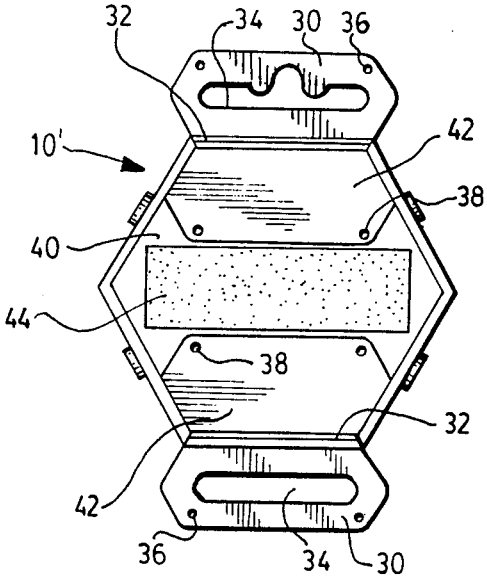
FIGS. 5A to 5E illustrate a multi-use carrying case design of a device constructed in accordance with another embodiment of the invention.
Figure 5B:
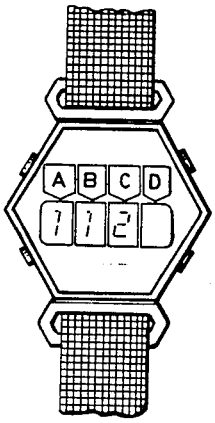
Figure 5C:
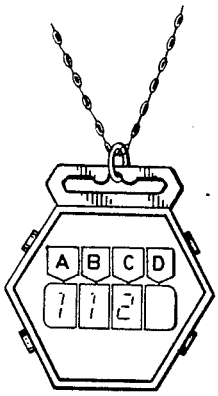
Figure 5D:
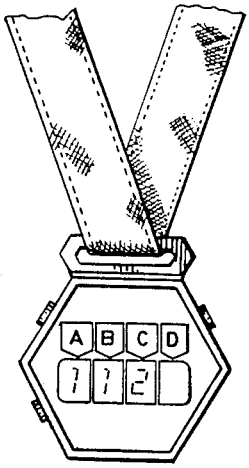
Figure 5E:
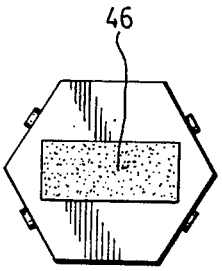

The device 10' may be carried in a variety of ways, as seen in FIG. 5B to 5D, the tabs 30 and the pressure-sensitive adhesive strip providing versatility with respect to such transportation.

In summary of this disclosure, by using state of the art technology and creative design concepts, the device of the invention offers one of the most exciting product developments for many years in the healthcare industry. Without doubt it will save countless lives and dollars. I predict that it will improve the compliance levels to heights yet unknown and will improve the calibre of health care on a global basis and will reduce, in a dramatic way, the rising costs of patient care. Modifications are possible within the scope of this invention.

What I claim is:

1. A medicament regime control device, comprising:

a housing having an upper face, display means associated with said upper face having a plurality of individual side-by-side displays for displaying numerals therein, electronic circuit means within said housing and operatively connected to said display means for controlling interchangeable messages conveyed by numerals displayed by said display means, including a message corresponding to the number of units of medication of selected ones of differing medicaments, and individual distinguished indicia on said upper face one adjacent each of said displays corresponding to individual medicament to be taken by a patient.

2. The device of claim 1, wherein said housing is of hexagonal shape.

3. A medicament regimen control device, which comprises:

a housing of hexagonal shape and having an upper face, said housing comprising a base and a transparent lid sliding and locking together to define an enclosure, display means associated with said upper face having a plurality of individual side-by-side displays for displaying numerals therein to convey selected messages corresponding to the number of units of medication of selected ones of differing medicaments, said display means being located in said enclosure, a die-cut card located against the underside of said transparent lid, said die-cut card having an elongate window corresponding in location to said display means, and individual distinguished indicia printed on said die-cut card one adjacent each of said displays corresponding to individual medicaments to be taken by a patient.

4. The device of claim 3, wherein said display means has four of said individual displays and said individual distinguished indicia comprise four differently-colored labels bearing different letters of the alphabet.

5. The device of claim 4, wherein said labels correspond to labels applied to containers of said medication.

6. The device of claim 3 including programmable electronic circuit means within said housing and operably connected to and controlling said display means and wherein recessed programming pins are located in the side of the device for selected programming of said electronic circuit means.

7. The device of claim 3 including programmable electronic circuit means within said housing and operably connected to and controlling said display means and wherein control button means is provided associated with the side of the device and operatively connected to said electronic circuit means.

8. The device of claim 4 having a package attached thereto containing four of said colored labels for affixing to containers of medication.

9. The device of claim 3 wherein a pressure-sensitive adhesive strip is provided on the rear wall of the device for affixing said device to a desired surface.

10. A medicament regimen control device, comprising:

a housing of hexagonal shape and having an upper face and a rear surface, display means associated with said upper face having a plurality of individual side-by-side displays for displaying numerals therein to convey selected messages corresponding to the number of units of medication of selected ones of differing medicaments, individual distinguished indicia on said upper face one adjacent each of said displays corresponding to individual medicaments to be taken by a patient, and tabs joined at the top and bottom of the device by a living hinge, each of said tabs having an elongated slot therein and the rear surface of the device having recesses for receipt of said tabs when not in use.

* * * * *